US005083689A

United States Patent [19]

Vaterlaus

[11] Patent Number: 5,083,689

[45] Date of Patent: Jan. 28, 1992

[54] OUTLET AND FLOW CONTROL DEVICE FOR METALLURGICAL VESSELS

[75] Inventor: Arthur Vaterlaus, Rüschlikon, Switzerland

[73] Assignee: Arva AG, Rüschlikon, Switzerland

[21] Appl. No.: 607,867

[22] Filed: Apr. 26, 1990

Related U.S. Application Data

[63] Continuation-in-part of Ser. No. 229,858, Aug. 31, 1988, Pat. No. 5,004,130.

[30] Foreign Application Priority Data

| | | | |
|---|---|---|---|
| Dec. 1, 1986 | [CH] | Switzerland | 4781/86 |
| Sep. 30, 1987 | [CH] | Switzerland | 3805/87 |
| Nov. 27, 1987 | [WO] | PCT Int'l Appl. | PCT/WO87/00161 |
| Dec. 14, 1989 | [CH] | Switzerland | 4503/89 |

[51] Int. Cl.[5] ..... B22D 11/10; B22D 41/20

[52] U.S. Cl. ..... 222/602; 164/437; 266/236; 266/271

[58] Field of Search ..... 164/437, 337; 222/602, 222/601, 598, 597, 591; 266/236, 271, 265

[56] References Cited

U.S. PATENT DOCUMENTS

| | | | |
|---|---|---|---|
| 633,991 | 10/1899 | Fisher | 222/602 |
| 668,450 | 2/1901 | McFadden | 222/602 |
| 3,083,422 | 4/1963 | Finkl | 164/61 X |
| 3,214,804 | 11/1965 | Saccomano | 222/602 X |
| 3,643,680 | 2/1972 | Hall et al. | 164/337 X |
| 3,651,825 | 3/1972 | Sury | 222/603 X |
| 4,728,012 | 3/1988 | Monks | 222/602 X |

FOREIGN PATENT DOCUMENTS

| | | | |
|---|---|---|---|
| 3414252 | 10/1985 | Fed. Rep. of Germany | 222/602 |
| 2315347 | 1/1977 | France . | |

*Primary Examiner*—J. Reed Batten, Jr.

*Attorney, Agent, or Firm*—Frishauf, Holtz, Goodman & Woodward

[57] ABSTRACT

To permit placement of a stopper element, preferably including a cylindrical alignment plug (13) accurately with respect to an outflow pipe (3, 3', 3'') of a metallurgical vessel adapted to contain a melt, an operating rod (5) vertically projecting from the stopper (6) is surrounded by a refractory sleeve (10), and secured to a support arm (23), which support arm is vertically movable and capable of transmitting rotation to the operating rod, the operating rod is connected to the support arm by a coupling link (48) which extends radially from the operating rod and is clamped by a clamping connection (46) to the support arm. The clamping connection (46) permits longitudinal adjustment of the upper end portion of the operating rod (5) as well as angular adjustment with respect to the support arm. Preferably, a part-spherical joint (50) couples the upper end portion of the operating arm (5) to the coupling link, and a part-spherical lower joint (11, 1311) with spherical surfaces formed on different materials connect the plug and/or adjacent portion of the sleeve (10) to the operating rod.

20 Claims, 9 Drawing Sheets

OUTLET AND FLOW CONTROL DEVICE FOR METALLURGICAL VESSELS

The present application is a continuation-in-part of application U.S. Ser. No. 07/229,858, filed Aug. 31, 1988 and now U.S. Pat. No. 5,004,130.

FIELD OF THE INVENTION

The invention relates to an outlet and flow control device for metallurgical vessels accommodating molten metals, in which a casting outlet is located at the bottom of the vessel and a stopper cooperates with the casting outlet and is located at the lower end of a vertically mobile rod projecting into the interior of the vessel.

BACKGROUND.

Numerous devices are already available for controlling the discharge and flow of molten metals from a vessel.

In the case of a very early system for casting steel or the like, use is made of a stopper mechanism in which the outlet aperture in the bottom of the vessel is adapted to be closed off by a stopper located in the interior of the vessel, the stopper being secured to the lower end of a rod. By means of a system of levers adapted to be actuated from the outside, the stopper may be raised for pouring and may be lowered again to close the outlet. The disadvantage of this system is that flow control and the shutoff safety is unsatisfactory, for example as a result of the formation of deposits or wear upon the stopper.

It has also already been proposed to use rotating valves by means of which an eccentric inlet duct can be brought into communication with an outlet aperture by a rotating connection. This requires very accurate machining and grinding of a difficult spherical joint between the rotating and the stationary components. Furthermore, the molten metal tends to solidify in the inlet aperture.

Also known are sliding closures built onto the bottom of the vessel containing the molten metal, but the closure elements, which slide one upon the other under preload are subject to considerable wear since movement of the adjustable parts must take place at the high temperatures of the molten metal. Another disadvantage is the high procurement and maintenance costs. Great accuracy in the machining of the slides, which are made of refractory material, is also required in order to achieve reliable sealing.

Another problem arising during the casting of molten metals is the need to prevent slag, and other non-metallic inclusions, from being carried along. Many attempts have been made to solve this problem. For example, it is known to use tundishes with partition-like displacement elements in order to promote separation of non-metallic inclusions in the molten metal. It has been found, in practice, that the carrying along of non-metallic inclusions by suction in the discharge area cannot be prevented. Apart from this, building up the dams and weirs after each casting cycle is very costly and time-consuming.

It has also been proposed to keep the slag away from the outlet by injecting an inert gas, but this involves a relatively major technical effort and the results are questionable. It is also known to arrange, concentrically with the discharge duct, a sensor based upon electromagnetism. This makes it possible to evaluate the difference in measurements of molten metal and slag, so that, when slag is detected, the casting process is halted. It is particularly difficult to introduce such sensors in areas of wear in the outlet duct. Furthermore, a certain amount of slag has to pass through the duct before it can be detected.

There is also the requirement that the molten metal should preferably not come into contact with air.

Another problem is that in the case of tundishes comprising one inlet and several outlets, the temperature of the molten metal at different outlets varies and this is undesirable.

Even if there is only one outlet, some of the molten metal flows directly from the inlet to the outlet and will therefore be at a temperature higher than that of metal circulating for some time in dead areas.

Separating non-metallic inclusions may also raise problems if the period of residence in the metallurgical vessel is too short, or if the melt is highly turbulent, since such inclusions require a certain amount of time to rise to the surface of the melt.

The components used to form the plugs for the outlets and their support elements can be of substantial size and hence heavy; for some installations, it is necessary to use hoists to place them in position It is frequently difficult to readjust the movable components after they are installed, and when a metal melt is filled in the vessel. Due to the high operating temperatures, however, the valve rod may bend or otherwise deform.

The tundishes are made of refractory material. When they are fitted in position, for example with refractory mortar or the like, positional tolerances may arise. Further, the entire metallurgical vessel may deform or warp, in the severe operating conditions encountered in foundry operation, and particularly in furnace operations for steel. Positional deviations, unintended and unavoidable, may arise which have to be compensated so that operating elements and especially elements subject to breakage and which are somewhat brittle do not break under bending stresses.

THE INVENTION

It is an object to couple a stopper which includes a plug to control outflow of a metal melt to an operating element such that longitudinal or angular positioning deviations can be compensated, and which will not apply bending forces on operating elements which might cause malfunction but, rather, permit easy adjustability, and particularly longitudinal adjustability with respect to an outlet aperture. Additionally, the system should be easy to install.

Briefly, the outlet valve controls flow of a metallic melt retained in a vessel, from which an essentially vertically positioned outlet pipe extends. A stopper which includes a plug is held by an operating rod extending in vertical direction within and outside of the vessel. The rod is surrounded, preferably, by a hollow sleeve or stem extending from the stopper and surrounding the operating rod with radial play or clearance.

In accordance with a feature of the invention, a stopper support arm extends laterally with respect to the operating rod. It is positioned above the level of the melt in the vessel, and coupled by a coupling link to the operating rod. The coupling link extends radially from the operating rod and is coupled thereto by an adjustable linkage, for example a ball joint, universal joint, or the like. The coupling link itself is attached to the operating rod by a clamping arrangement which permits longitudinal movement of the coupling rod along the support arm as well as angular displacement of the coupling link with respect to the orientation of the support arm. Preferably, the support arm is vertically movable, for example by a hydraulic piston-cylinder arrangement.

The system has the advantage that a connection can be made in which misalignment of the plug operating rod with respect to the outlet pipe is effectively eliminated by permitting self-alignment; at the same time, interference between the operating rod within the hollow sleeve or stem is also avoided. Positioning the coupling link, at selected positions longitudinally thereof, and releasing the coupling link, permits, upon release thereof, lifting of the plug and operating rod out of the position in the vessel, for example for cleaning, maintenance and the like, without disturbing the position of the support arm. Lifting-out of the operating rods and the components connected thereto may require a crane or a hoist. A new valve plug, and repaired or new operating elements, can then be reinstalled by the crane or hoist and placed in appropriate position on the support arm without having had to disturb the support arm, because the intermediate coupling link permitted vertical access toward the outlet pipe without laterally swinging away the support arm.

The enforced, largely horizontal direction flow of near the outlet from the metallurgical vessel produces a smooth flow with no vortexing and thus no premature carrying along of slag. Since the horizontal casting outlet can be rotated during the casting process, it is possible to adapt flow conditions to the shape of the relevant vessel, to different levels in the bath, to the melting temperature, and to other parameters, from case to case or continuously. As a result of the smooth inlet flow through the pouring distributor, there are no rebound waves of molten metal from the bottom and this avoids flushing of the floating layer of slag preventing reoxidizing. The smooth flow also facilitates and accelerates the ascent of non-metallic inclusions to the surface of the molten metal.

DRAWINGS

The figures illustrate examples of embodiments of the invention:

Figure 12A:
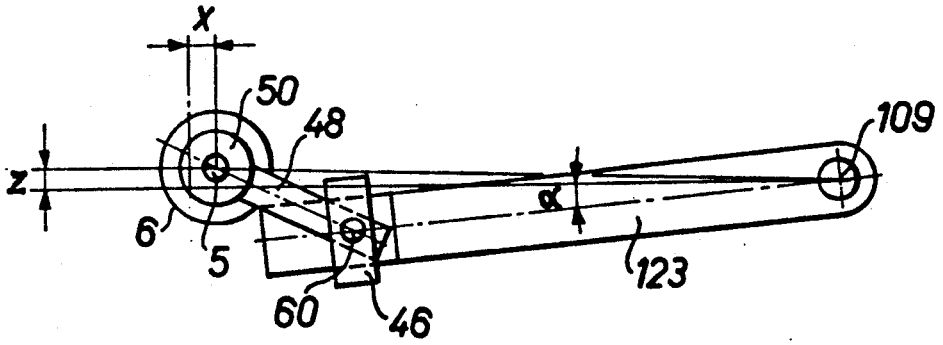
Figure 12B:
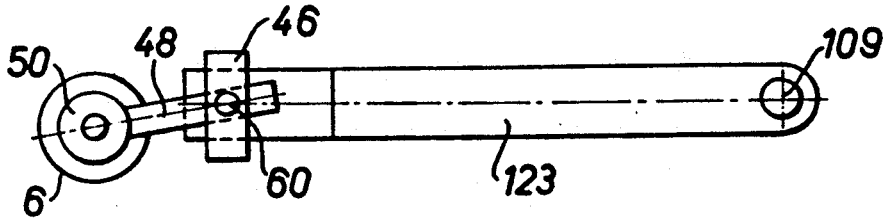
Figure 13:
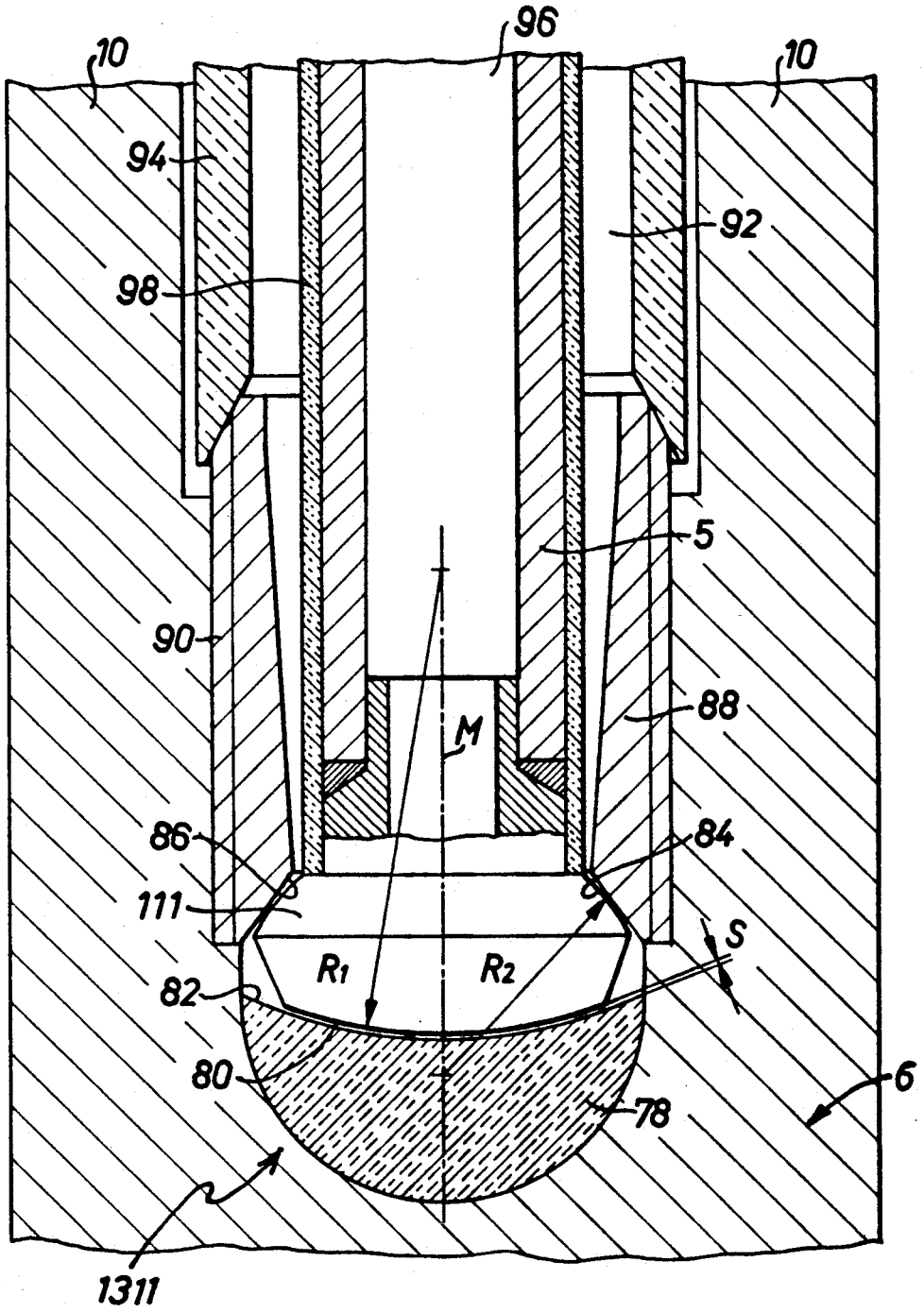

FIGS. 12*a* and 12*b* are schematic top views of different clamping arrangements possible in accordance with the present invention and illustrating realignment of the operating rod for the plug in accordance with selected positions of the outlet aperture from the melt vessel; and FIG. 13 is a fragmentary sectional view, to a different scale, of a floating link connection between the stopper and the operating rod at the lower end of the operating rod.

DETAILED DESCRIPTION

Figure 1:
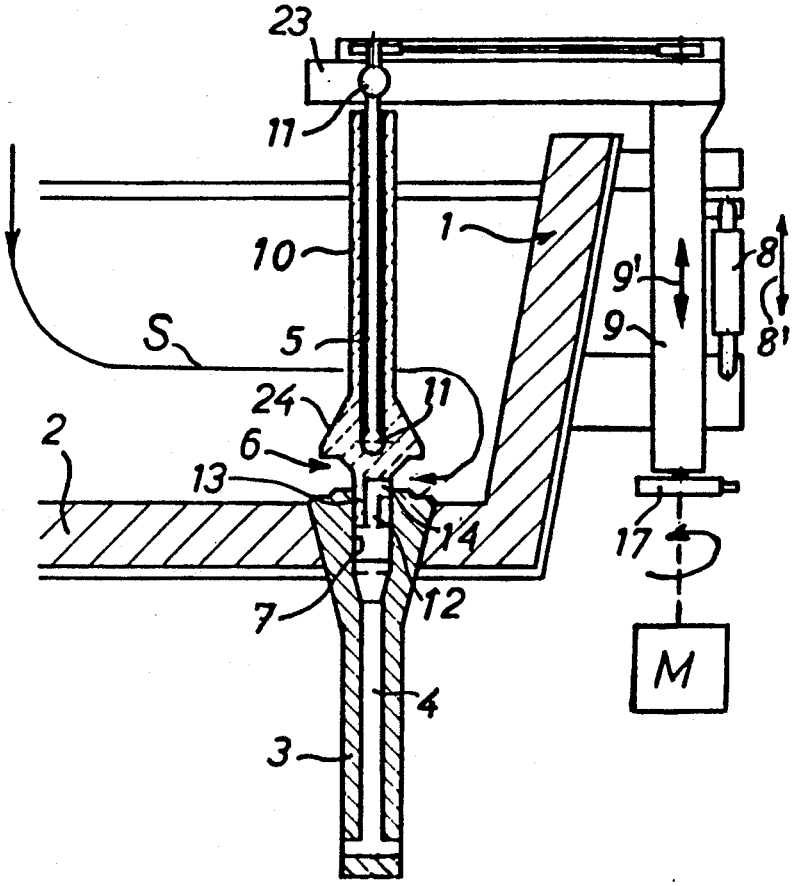
FIG. 1 is a cross-section through the device together with the melting vessel.

According to FIG. 1, an outlet aperture, with an outlet pipe 3 open at the bottom, is located in bottom 2 of a vessel 1 which holds molten metal. Projecting into bore 7 of outlet pipe 3 is a stopper 6 made of a refractory material by means of which the flow of molten metal can be regulated.

An operating or stopper rod 5 projects into hollow neck or sleeve-like extension or stem 10 of the stopper 6, the rod 5 permitting the stopper to be moved vertically and to be rotated about its axis. Movement is controlled by a drive mechanism 17 located externally of vessel 1. The vertical drive may consist of a mechanical, motor-driven spindle 8 or of a hydraulic or pneumatic lifting cylinder (see arrow 8'). A horizontal arm 23 is connected, above the edge of the vessel to a vertical guide element 9 and movable as shown by arrow 9'. The connections between the upper end of stopper rod 5 and arm 23, and between the lower end of the stopper rod and bell-like head 24 of the stopper are by floating couplings, namely connections in the form of ball joints 11. The stopper rod 5 held in hollow sleeve 10 has radial play. A rotary drive 17, used to rotate stopper 6 about its vertical axis, is connected to a drive-motor M. This motor may be a servo- or stepping-motor, e.g. a position-controlled motor by means of which the different rotational positions of stopper 6 may be programmed and reproduced. The change in the rotational position of the stopper may also be effected by a pneumatic or hydraulic drive. Rotation is transferred between rod 5 and sleeve 10 by a key 27 (FIG. 2) on rod 5 engaging a groove or spline 29 in sleeve 10.

Stopper 6 comprises a cylindrical plug 13 engaging in bore 7 of outlet duct 4 and is provided with a horizontal, radial throttle aperture 14 which opens into a passage part 12 and merges into outlet duct 4. Since plug 13 is open radially only on one side, a predetermined flow direction is imparted to the emerging molten metal, as shown by line S in FIG. 1. In the area in front of the casting aperture, together with the bell-like stopper head 24, which is larger in diameter than plug 13, the most horizontal flow possible is sought in order to prevent vortexing of the molten metal and the sucking-in of slag from above. The direction of flow may also be varied, stepwise or continuously, during the casting process, by rotating the stopper about its vertical axis. Lowering the stopper reduces the flow cross-section of the throttle aperture, or shuts it off completely.

The stopper linkage and arm 23 can be locked or clamped on upper ball joint 11 of stopper rod 5 automatically by means of a clamping device to transfer rotational force and rotate sleeve 10, as well as to transfer vertical forces. Initially, the stopper rod, which moves with play, and stopper 6 need not be accurately aligned. The neck 10, formed as a sleeve hollow stem (see FIG. 1),provides protection from the molten metal and the ball joints or couplings 11 provide alignment play. The control forces pass through the linkage 23, ball joints 11 and via key 27 and spline 29 directly into the head of the stopper when the upper ball joint 11 is clamped; yet the stopper 6 is protected from flexural forces arising from misalignment. The usual operations needed to align stopper 6 on the outlet pipe 3 are eliminated and the stopper can be positioned automatically even in hot metallurgical vessels, since the ball joints 11 permit limited relative deflection in vertical and horizontal planes between the sleeve 10 and rod 5. This results in a reduction in vessel turn-around time and thus a reduction in maintenance time.

The design of a variant of stopper 6 in the closed and open position is described hereinafter in conjunction with FIGS. 2 and 3. The stopper comprises a cylindrical or slightly conical plug projecting into bore 7 of casting pipe 3. Located in plug 13—in contrast to the design according to FIG. 1—are several radial throttle apertures 14 distributed uniformly around the periphery of the plug. The upper and lower areas have parallel vertical lateral walls 35. The longitudinal axes of the said throttle apertures extend vertically, i.e. in the direction of movement of the stopper. This provides more advantageous control characteristics as compared with circular throttle apertures. Throttle apertures 14 open into the central lower open longitudinal bore part 15 of plug 13. Above the apertures, plug 13 merges into a frustoconical expansion 16 which forms a frustoconical shut-off surface having a central angle of between 75° and 105°, preferably 90°. Together with a frustoconical counterbore 18 of the same angle at the upper edge of bore 7; this forms a first annular seal 20. Located between the uppermost edge of throttle apertures 14 and frustoconical shut-off surface 16, on plug 13, is a closed cylindrical annular part 19 of width V (FIG. 3). When stopper 16 is closed, i.e. lowered, this annular part 19 provides, together with adjacent cylindrical bore 7, of matching diameter, a second seal 21. The lowermost part of plug 13 is also in the form of an annular part 22 closed at the casing. Thus plug 13 remains guided in bore 7 even when throttle apertures 14 are fully open.

Figure 2:
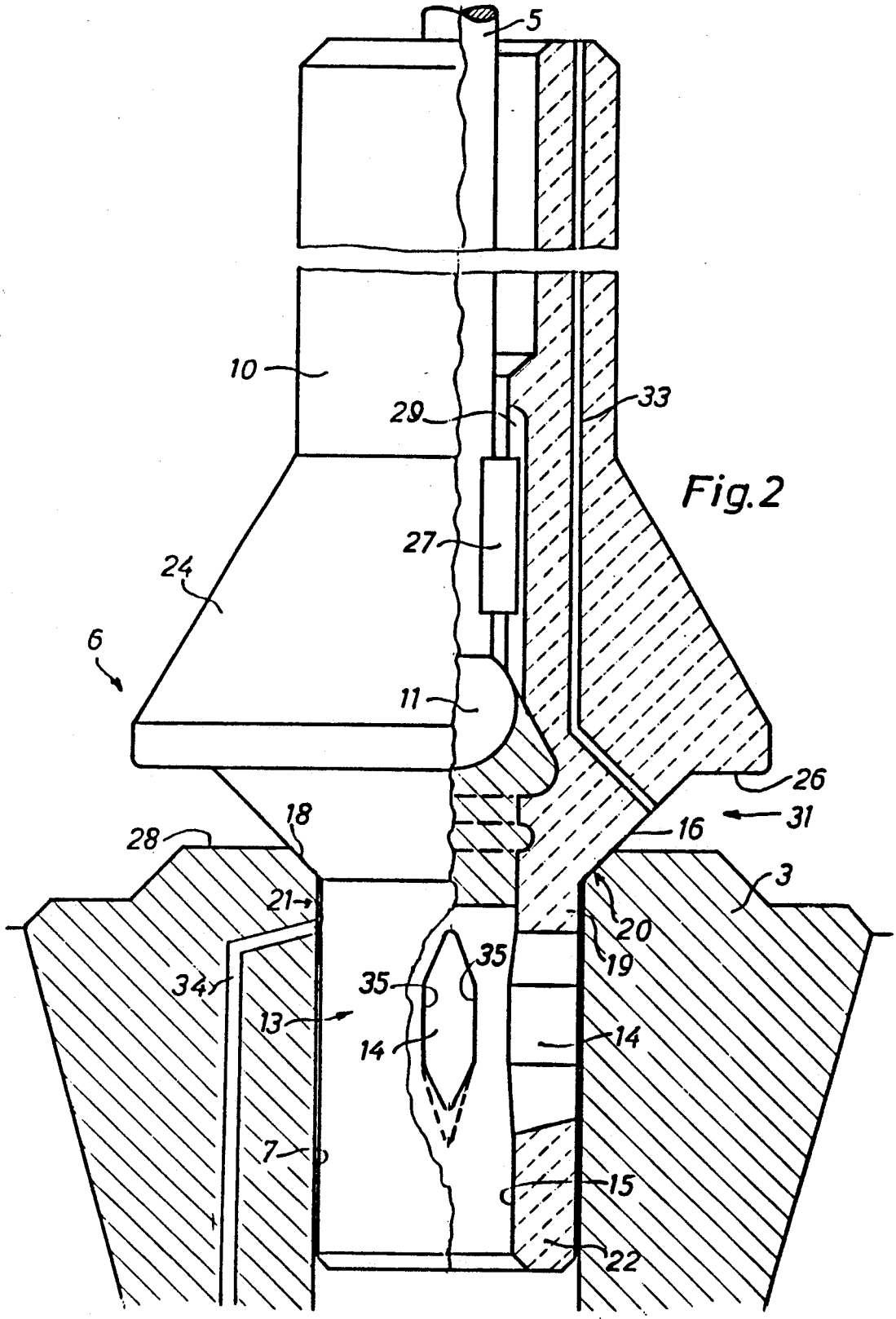
FIG. 2 is a partial section through the stopper in its closed position projecting into the casting aperture.
Figure 3:
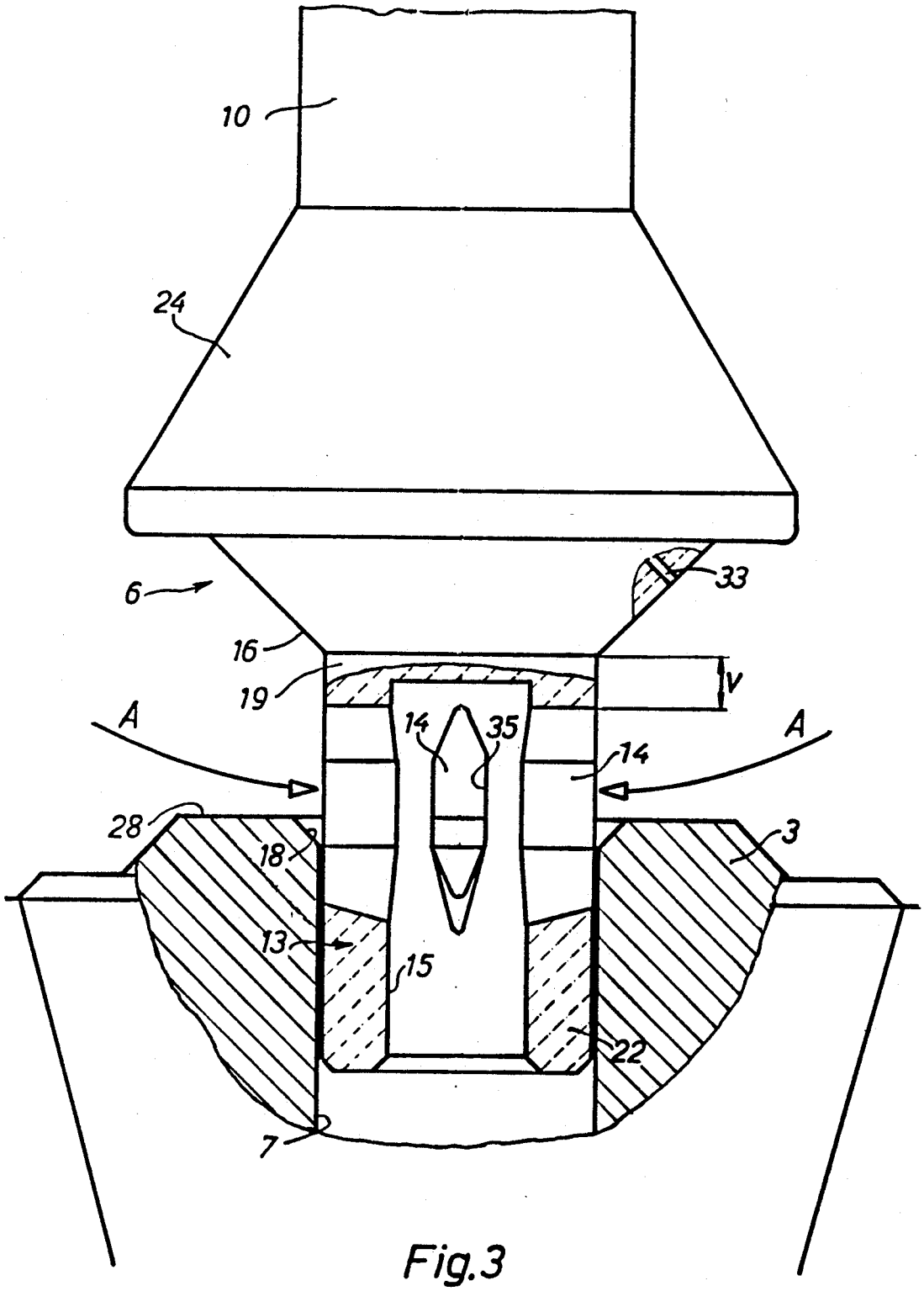
FIG. 3 is a section through the stopper in its open position.

Since, when stopper 6 is in the closed position according to FIG. 2, throttle apertures 14 are not in contact with the molten metal, there is no danger of the molten metal freezing in this area. Above frustoconical expansion 16, stopper head 24 is expanded into the form of a bell. This prevents, or greatly reduces, a discharge vortex in the interior of vessel 1, thus preventing slag inclusions from being carried along. When stopper 6 is closed, the approximately horizontal lower edge 26 of expanded stopper head 24 is relatively far away from horizontal surface 28 of casting pipe 3, so that a relatively wide annular space 31 is provided for the molten metal in front of first seal 20. This relatively large mass of molten metal surrounding bore 7 reduces its cooling and counteracts any blockage. In addition to this, the design of stopper head 24 imparts an approximately horizontal flow to the incoming molten metal, as indicated in FIG. 3 by arrows A. This prevents a vertical vortex from forming in the molten metal, even if the level thereof in the vessel is low. Slag is thus not drawn prematurely into the discharge. Furthermore, this annular space 30 may be flushed with argon or the like which may be fed to stopper 6 by thin supply lines 33 which may also be used to produce a control signal. As soon as the outlet end emerges from the molten metal, there is a drop in the pressure of gas in the supply line. This makes it possible to shut off the casting flow before any slag is included therein.

Since two seals, acting consecutively, are provided, this reduces the risk of a breakthrough of molten metal, even if surface 16 or counterbore 18 of first seal 20 is damaged by wear.

Second seal 21 may also be kept free of incoming molten metal by injecting gas through passages 34.

Figure 4:
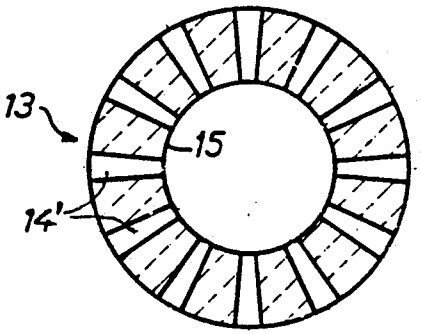
FIG. 4 is a cross-section through a variant in the direction of arrows IV—IV in FIG. 5.
Figure 5:
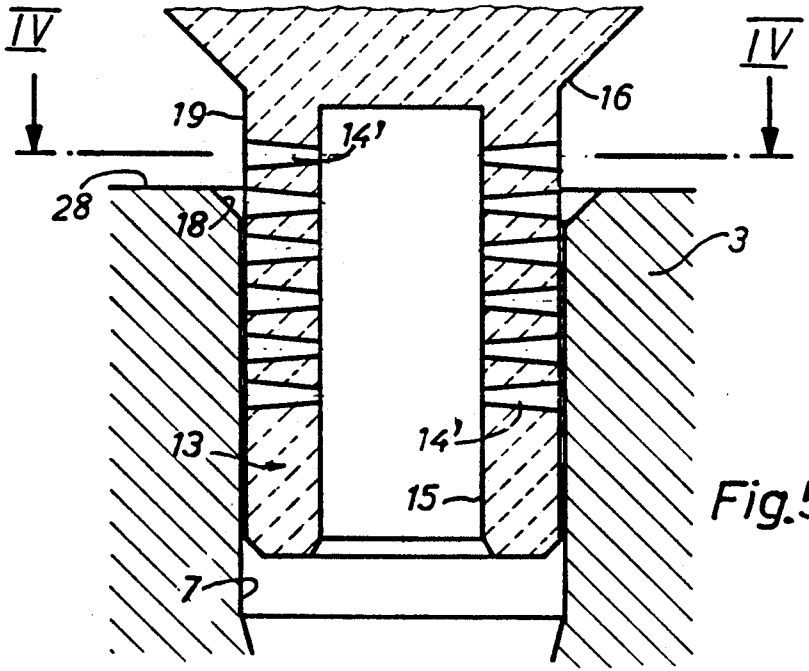
FIG. 5 is a longitudinal section through the variant according to FIG. 4 with a plurality of throttle apertures.

FIGS. 4 and 5 illustrate a variant in which the throttle apertures in stopper 6 consist of a plurality of relatively small radial holes 14' around the periphery, arranged one above the other in axial rows. This provides filtration of the molten metal. If upper holes 14' are blocked off, stopper 6 is raised so that new, still open holes are exposed for flow and filtration.

Figure 6:
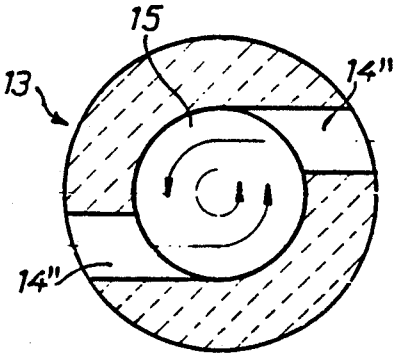
FIG. 6 is a cross-section through another variant with staggered throttle apertures producing a twist in the emerging molten metal.

In the variant, according to FIG. 6, two throttle apertures 14'' are arranged on opposite sides of plug 13 and are staggered in relation to the center line so that they run approximately tangentially to longitudinal discharge opening 15. This imparts to the emerging molten metal a twist as shown by the arrow. This prevents the formation of deposits upon the outlet, since lighter inclusion remain in the center of the vortex.

Figure 7:
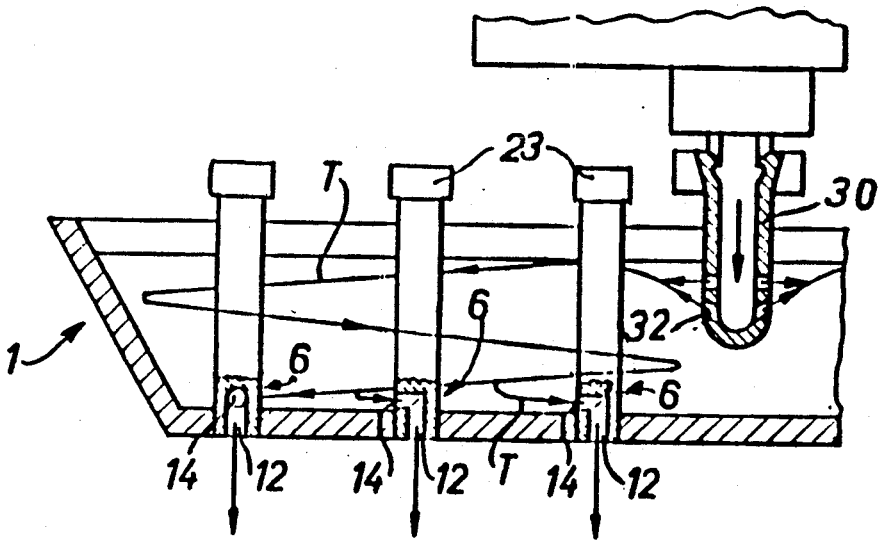
FIG. 7 is a longitudinal section through a vessel in the form of an intermediate receptacle with a pouring distributor and a plurality of stoppers.
Figure 8:
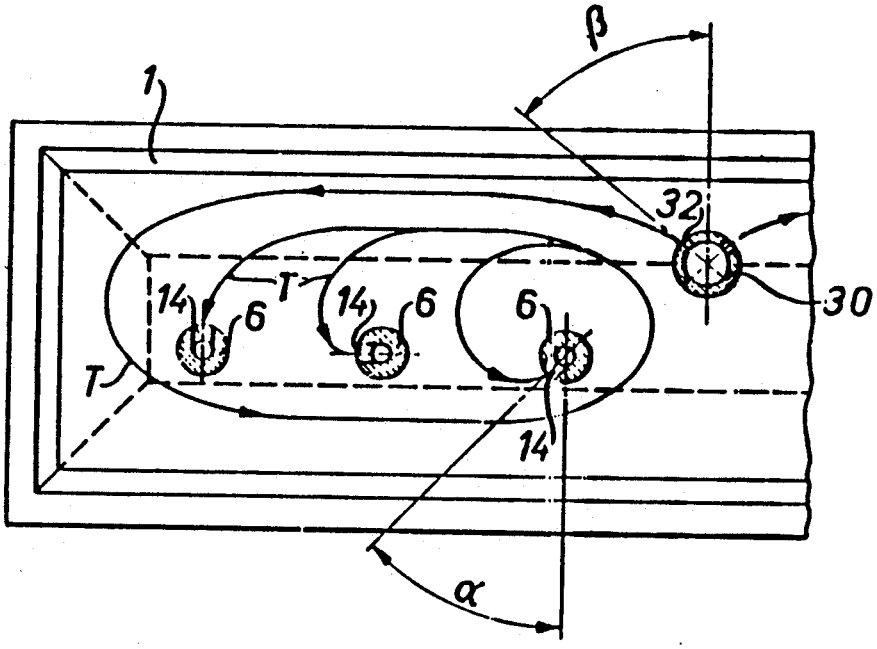
FIG. 8 is a plan view of the intermediate receptacle according to FIG. 7 showing the different rotational positions of the casting apertures in the plugs in cross-section.
Figure 9:
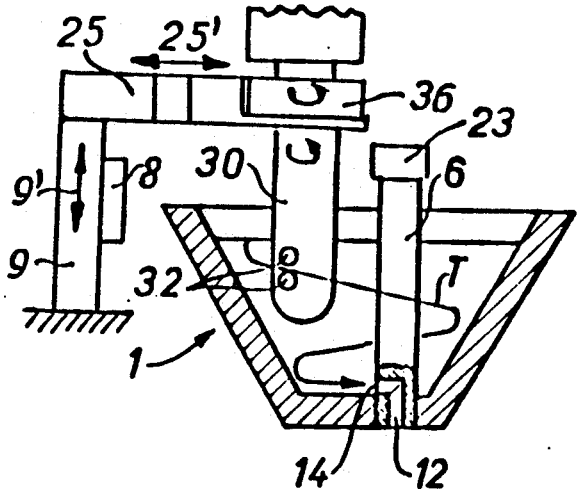
FIG. 9 is a cross-section through the intermediate receptacle according to FIG. 7 with a sharper downward cross-sectional taper.

FIGS. 7, 8 and 9 illustrate a variant in which vessel 1 is in the form of an intermediate receptacle with a pouring distributor 30 and several stoppers adapted to rotate independently of each other. In the case of such distributing vessels or intermediate receptacles with a plurality of casting outlets, the problem is that the difference in the length of the paths travelled produced different temperatures in the molten metal, and this is undesirable. Immersing the pouring distributor 30 in the molten metal, and outlet apertures 32, below the level of the bath, which is directed, rotatable by a drive element 36 and predominantly horizontal, causes the molten metal to emerge approximately horizontally and produces a smooth flow approximately in the direction of path T in FIGS. 7, 8 and 9. This flow is dependent upon inflow angle $\beta$ (FIG. 8) of pouring distributor 30 and upon outflow angle $\alpha$ of stopper 6. The flow vectors of the outlet and inlet produce a torque in the molten metal, as a result of which individual elements of the melt descend, from the hot layer near the surface, spirally to the colder layer near the bottom. The purpose of the spiral flow is to achieve paths of roughly the same length for all throttle apertures 14 in order to avoid temperature differences. Flow paths T, shown diagrammatically in FIGS. 7, 8 and 9, cannot actually be maintained in practice, but since the part flows in the metal are thoroughly mixed, temperature distribution is satisfactory and dead areas are avoided. FIGS. 7 and 8 show only one half of such an intermediate receptacle.

The period of residence of the molten metal in vessel 1 may be influenced by the choice of angles $\alpha$ and $\beta$. The smooth flow provides an opportunity for non-metallic inclusions to ascend rapidly, by their own buoyancy, to the surface and into the layer of slag floating thereupon, so that they are not carried along by turbulence into the outlet duct. This also applies to slag. The substantially horizontal flow obtaining in the casting area of metallurgical vessel 1 eliminates vortices and premature carrying along of slag, and this improves the quality of the end product, reduces scrap, and increases production.

FIG. 9 shows a cross-section through the intermediate receptacle from which it may be seen that the walls slope sharply, thus producing a preferred flow path. FIG. 9 also shows by arrows 9' and 25' vertical and horizontal adjustment effected by suitable positioning elements or motors, along guides 9 and 25.

Individual stoppers 6 according to FIGS. 7 to 9 correspond to those according to FIG. 1 and may thus be raised, lowered and rotated as explained in connection FIG. 1. Individual or joint control may be effected by a predetermined program as a function of casting parameters such as temperature, throughput and analysis. Data-processing units may also be used for this purpose. Pouring distributor 30 may also be included in such a programmed control, i.e. angle $\beta$ and/or the height thereof may be varied. The throttle cross-sections in stopper 6 may also be adjusted individually by raising or lowering.

Figure 10:
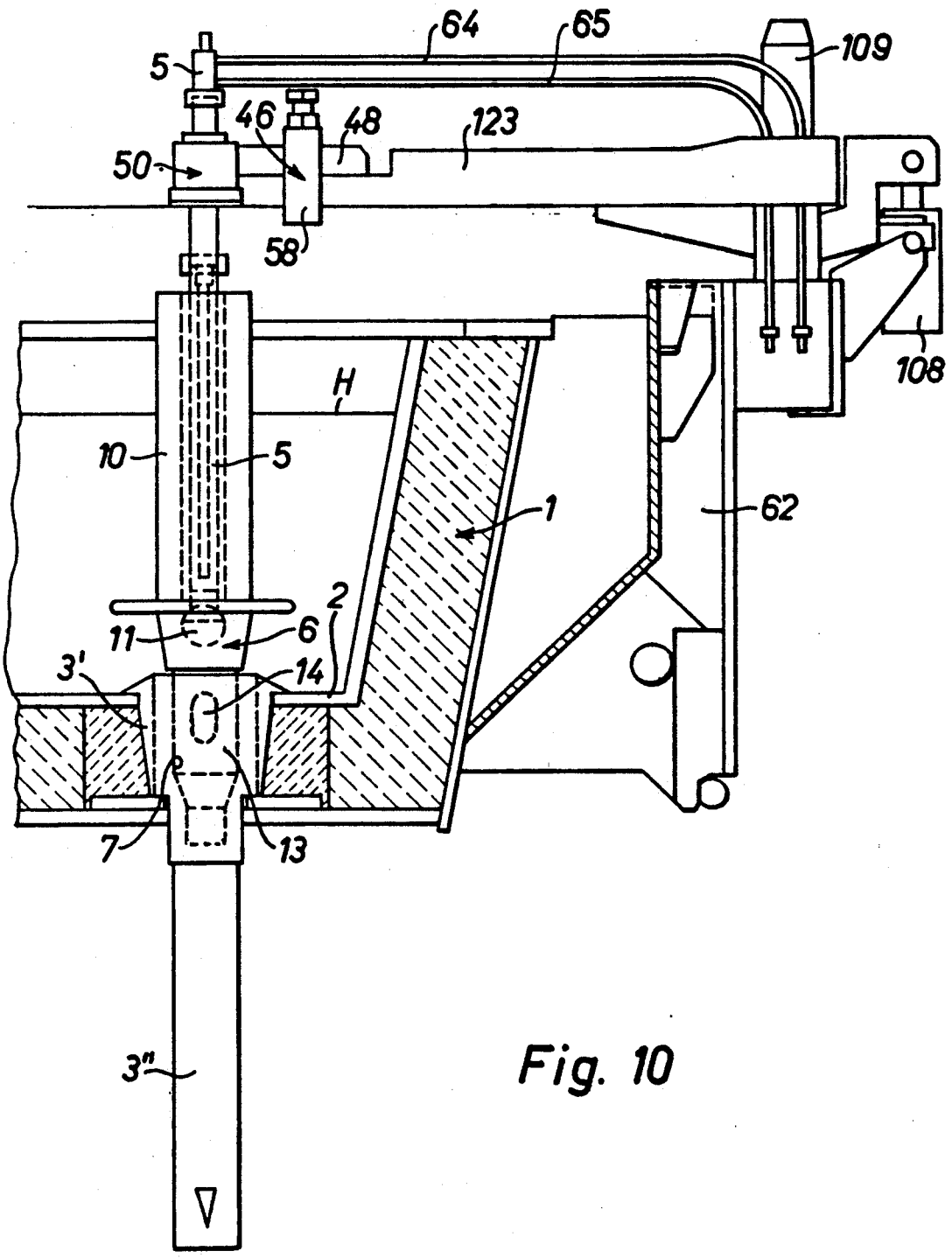
FIG. 10 is a vertical schematic cross-sectional view through the vessel and illustrating the holding arrangement for the plug in greater detail.

The arrangement using two seals, 21 has the advantage of highly effective sealing; one seal, however, may be all that is required for many applications. FIG. 10 illustrates, in schematic form, a cross-section in which, effectively, only a single seal is used.

The bottom 2 of the metallurgical vessel 1 has an outlet pipe 3 set therein. The outlet pipe 3 has an outlet socket 3' and an extending outlet pipe extension 3''. The socket 3' is arranged to be sealed by the stopper 6 which includes a plug 13. The outlet element 3 as well as the vessel 1 are made of refractory material. The level of the metal in the vessel 1 is schematically shown by the level line H which indicates a maximum level. The plug 13 is formed with a radial opening 14 which terminates in a central bore thereof, open to the bottom. By height adjustment of the stopper 6, and hence of the plug 13, the flow of the melt through the outlet pipe 3'' can be controlled and, when the stopper 6 is seated on the end portion of the outlet element 3, it is entirely inhibited. As described in connection with FIGS. 1-3, one or two seals are formed by the stopper and plug 6, 13. If two seals are provided, they act cumulatively. The first seal is a conical seal at the upper edge of the socket 3'; a second seal, if two are used, is formed by the cylindrical portion of the plug 13 above the opening 14 thereacross, and when fitted into the bore of the outlet socket 3'.

The stopper 6 is formed with a widened portion at its upper end which supports the hollow sleeve 10, terminating above the maximum level H of the melt.

The hollow sleeve 10 has a central opening into which the operating rod 5 extends. The operating rod is thinner than the width of the opening in the sleeve 10, so that there is radial clearance or play between the rod 5 and the interior walls of the sleeve 10.

The operating rod 5 is coupled to the plug 13 by a joint which is movable and forms a link joint. A preferred form is a ball joint 11, although a universal joint could be used which, however, is more expensive to make.

In accordance with a feature of the invention, the upper end portion of the rod 5 is retained on a laterally projecting support arm 123, similar to arm 23, by an intermediate coupling link 48. The coupling link 48 extends radially from the rod 5 in a horizontal direction, and is coupled to the rod 5 by a link coupling or link structure which, for example, again is a ball joint, a universal joint or the like. The coupling link 48 is connected to the support arm 123 by an adjustable, releasable and retightenable clamping connection 46. The arm 123 is height-adjustably secured to the metallurgical vessel 1, and is used to lift and lower the operating rod 5 and hence the stopper 6 and plug !3. Vertical movement, in accordance with a preferred feature of the invention, of the support arm 23 is obtained by a hydraulic cylinder 108. The support arm 123 is guided on a cylindrical post 109. The cylindrical post 109 and the hydraulic cylinder 108 are secured to a frame 62 which, in turn, is securely rigidly coupled to the metallurgical vessel 1. Cooling air is supplied and removed by two ducts 64, 65, for example flexible hoses, which are coupled to longitudinal bores formed in the rod 5.

The coupling link 48 is connected to the operating rod 5 by a universally movable joint, preferably a ball joint bearing.

Figure 11:
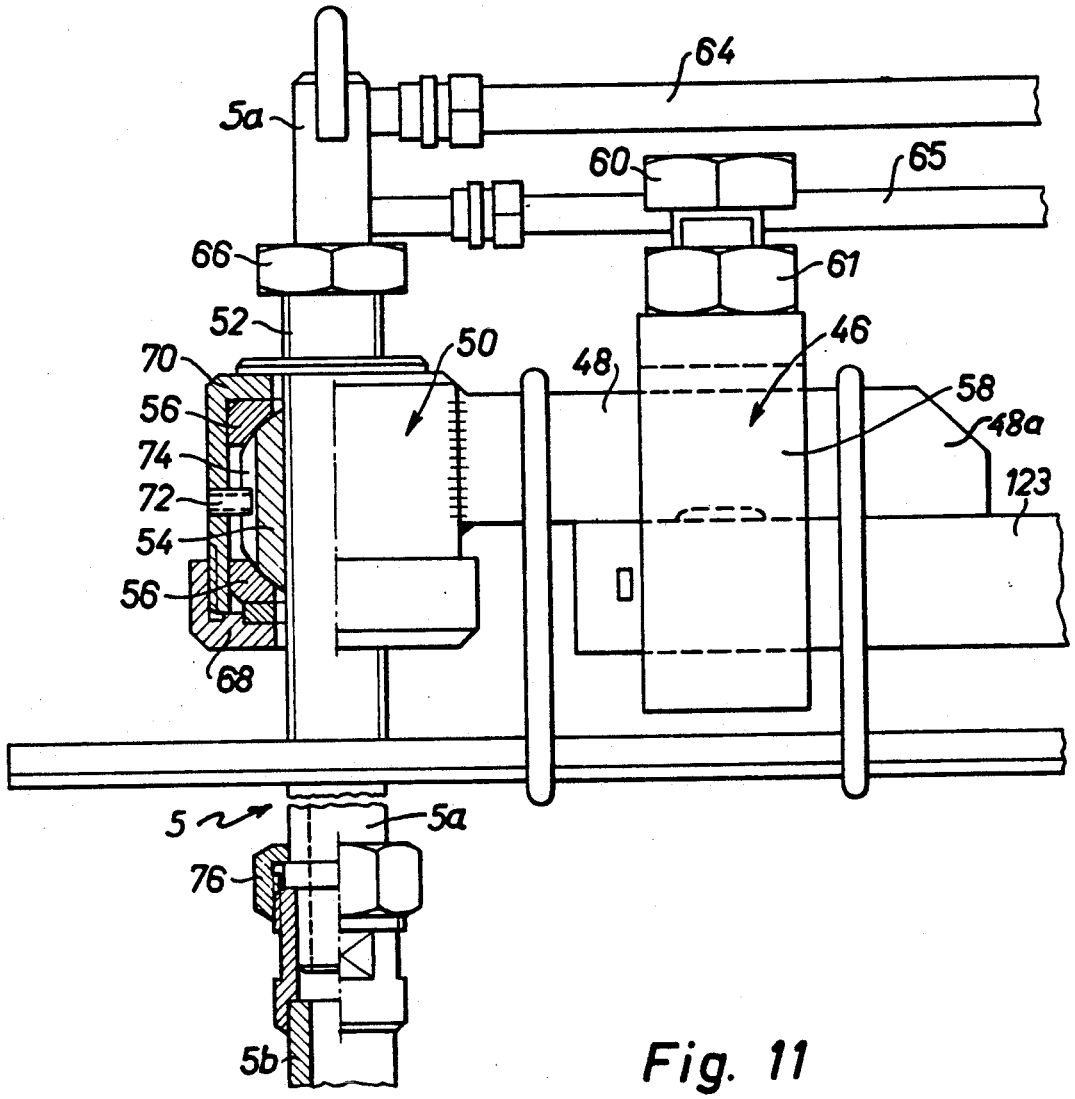
FIG. 11 is a detailed view of the coupling link, and the connection thereof to the operating rod.

Referring to FIG. 11, which illustrates the structure in greater detail, the ball joint bearing 50 includes a part-spherical inner insert 54 which is screwed on a spindle 52. The spindle 52 is hollow and rod 5 passes therethrough. By rotating the spindle 52, for example by a wrench engageable with wrench surfaces 66, the height position of the part-spherical insert 54 can be changed and adjusted. Bearing inserts 56, with part-spherical inner surfaces, are located in engagement with the part-spherical insert 54, above and below the insert 54. The rings 56 are supported in a housing 68 and in a cover 70. A pin 72, fitted in housing 68, engages in a vertical groove 74 of the part-spherical insert 54.

For ease of assembly, the operating rod 5 is separated into two vertical portions 5*a*, 5*b*. The portions 5*a*, 5*b* are retained in longitudinal alignment by a union 76.

The support arm 123 and the coupling link 48 are clamped together along parallel planes, and held in position by the clamp arrangement 46. The clamp arrangement 46 includes a screw 60 and a counter nut 61, the screw 60 being screwed into an upper cross element of a bridge 58 spanning over a horizontal portion 48*a* of the coupling link, and having laterally, inwardly directed jaws or an inward strut element passing around and beneath the support arm 123. The engagement surface of the support arm 123 is substantially wider than the surface of the extending portion 48*a* of the coupling link 48, so that the coupling link 48 can be shifted not only longitudinally along the support arm 123 but, additionally, can be pivoted with respect to the direction of the support arm 123, as best seen by comparing FIGS. 12*a* and 12*b*.

Assembly of stopper 6 and plug 13 with respect to outlet socket 3', and operation:

It can be assumed that the outlet socket 3' and its connected outlet tube 3''' cannot be accurately secured in the vessel 1, so that positional differences between the stopper 6 and the outlet may arise. Due to the lever effect and the relatively long operating rod 5, substantial forces may arise at the upper end thereof. To prevent bending forces from being applied to the operating rod 5, the angular as well as positonal differences can be compensated by loosening the clamping arrangement 46 and adjusting the bridge 58 longitudinally along the support arm 123 as well as angularly adjusting the link arm 48*a*, compare FIGS. 12*a*, 12*b*. This adjustment is possible in two dimensions, namely z and x, and along the angle Y (FIG. 12*a*).

The operating rod 5 and the stopper 6, including the sleeve 12, can be very heavy and require a crane or hoist for handling. To eliminate the necessity of moving the support arm 123 laterally, to permit access vertically towards the outlet 3, the support arm 123 is foreshortened and does not extend close towards the bearing or link 50 but, rather, is spaced therefrom by some distance, sufficient to permit the sleeve 10 together with the operating rod 5 to be moved from the top vertically downwardly, with clearance, along the end of the support arm 123, for example by a crane or hoist. The coupling link 48 then is used to connect the bearing or part-spherical joint 50 to the support arm 123 so that the operating rod will be held in position, movable vertically, and, if desired, rotationally as explained above, with respect to the vessel 1. A comparison of FIGS. 12*a*, 12*b* clearly illustrates various possibilities obtainable with respect to angular as well as longitudinal adjustment between the coupling link 48 and the support arm 123. The releasable clamping arrangement 46 permits release of the clamping arrangement from the support arm so that the stopper 6 and plug 13, together with their operating rod and a sleeve or stem 10, can readily be aligned with the center of the bore of the outlet 3, and then clamping the coupling link in position. Laterally pivoting away of the support arm 23 is not necessary anymore.

The coupling link 48 can be engaged against the support arm 123 from above, as shown in FIG. 11, or from below. The arrangement shown in FIG. 11 is preferred since it provides for better visible adjustment. Of course, other ways of clamping, while permitting relative adjustment orientation, of the coupling link 48 on the support arm 123 can be used, for example also including hydraulic pressure arrangements.

The link connection of the operating rod 5 with the stopper 6 on one end and the support arm 123 on the other permits relative adjustment and floating realignment; while ball-and-socket joints are preferred, other arrangements may be used. The intermediate coupling link 48 permits not only ease of adjustment of the position of the operating rod, even though it may be bent, warped or deformed in operation, but also provides for clearance during assembly and disassembly. It is comparatively difficult to preassemble the operating rod 5 so that it will move freely. The operating rod 5 as well as the support arm 23, 123 are heavy and, after assembly, can hardly ever be laterally adjusted without difficulty, and especially after the apparatus has been in use for some time. Yet, the operating rod 5, in spite of the protective sleeve 10, may bend or warp due to the high operating temperatures to which it is subjected. Use of two link or floating connections, for example the ball joints 11 and 50, and especially the upper joint 50, permits self-realignment and hence prevents the application of bending forces on the stopper 6, the plug element 13, and the outlet 3 with which they cooperate. While the lower ball joint 11 is preferred when used together with the upper joint 50, a single joint and, if so, preferably placed at the lower region of the operating rod 5, is sufficient for some installations.

The operating rod 5 is subject to the highest temperature at the lower end, that is, where it is coupled to the plug 6. The plug 6 and the sleeve 10 can be unitary. Referring now to FIG. 13, which illustrates a preferred arrangement by which a movable coupling of the operating rod 5 with the sleeve 10 is ensured.

FIG. 13 illustrates, to a scale substantially enlarged with respect to that of FIGS. 1 and 10, a joint or link 1113. The sleeve 10 is formed with a blind or terminated bore therein, which is filled with a heat-resistant material 78, for example a silica, the silica being filled into an essentially spherical end portion of the blind bore.

The upper surface of the silica fill 78 has approximately spherical contour and forms a surface 82. The head portion 111 of the rod 5, at least, or the entire rod 5, is made of high heat-resistant, high-quality steel. It can be fitted as a separate element into the rod 5, and securely connected thereto, for example by welding. The head portion 111 is formed at its lower side with a spherical surface 80 of radius R1, which cooperates with a first spherical counter surface 82 on the fill insert 78. There is a slight play or gap S between the surfaces 80, 82. A second, essentially ring-shaped and preferably spherical surface 84 with a radius R2 is formed at the upper side of the insert 111. The surface 84 cooperates with an approximately conical counter surface 86 of a bushing 88 which is screwed by thread 90 into a bore of the sleeve 10. Surface 84 is opposite surface 80.

The two radii R1 and R2 are unequal. Their centers are, spaced mutually from each other, on the longitudinal axis M of the rod 5.

The possible angular deviation of the rod 5 in the ring space 92 between the rod 5 and the sleeve 10 is only a few degrees. The difference between the two radii R1, R2 can be compensated, upon angular deflection, by the play or gap S, since the radius R1 engages only under pressure, and the radius R2 engages only under tension against the respective counter surface 80, 86.

A tubular element 94 engages against the bushing 88. The operating rod 5 is protected against excessive heat by a heat insulating layer 98 and is hollow, interiorly, by being formed with one or more cooling bores, shown only as a single bore 96.

The two surfaces 84, 86 are formed, preferably, also of different materials.

The first counter surface 82 need not be spherical, but could be conical or flat.

Various changes and modifications may be made, and any features described in connection herewith may be used with any of the others, within the scope of the inventive concept.

I claim:

1. An outlet valve structure to control flow of a metallic melt, adapted for installation in the bottom (2) of a vessel (1) containing the melt, said valve structure comprising an essentially vertically positioned outlet pipe (3, 3', 3'') having a vertical bore (7) therethrough;

stopper means (6) dimensioned and shaped to fit against said outlet pipe;

an operating rod (5) extending in vertical direction within and outside of said vessel (1);

a hollow sleeve or stem (10) extending from said stopper means (6) and surrounding said operating rod with radial play or clearance; and a stopper support arm (23, 123) extending laterally of the operating rod (5) and above the level (H) of the melt in the vessel, and further comprising, a coupling link (48) radially extending from the operating rod (5), said coupling link being coupled to said operating rod;

means (46) for connecting said coupling link (48) to said support arm (23, 123), said connecting means (46) comprising a releasable and adjustable clamping arrangement (46) which permits change in position of the coupling link (48) with respect to the support arm in a longitudinal direction of the support arm as well as with respect to angular orientation of the coupling link relative to the support arm.

2. The structure according to claim 1, further including a floating coupling means (50) coupling said coupling link (48) to said operating rod (5) to permit relative angular deflection of the operating rod with respect to the coupling link; and vertical positioning means (52) adjustably positioning the level of the floating coupling means (50) on the operating rod (5) for positioning the vertical level of the coupling link (48) with respect to the operating rod, and hence the stopper means (6).

3. The structure according to claim 2, wherein said vertical positioning means includes a hollow spindle (52) surrounding the operating rod (5);

an at least part-spherical element (54) coupled to said spindle; and means (68, 70, 72, 74; 56) for coupling said at least part-spherical portion (54) with the coupling link.

4. The structure according to claim 1, further including floating coupling means (54, 56) coupling said coupling link (48) with the operating rod (5).

5. The structure according to claim 4, wherein said floating coupling means comprises an at least part-spherical ball joint.

6. The structure according to claim 1, wherein said connecting means (46) comprises a bridge-and-jaw clamp (58) engaging over and at least partly around the support arm (23, 123) and an extending portion (48*a*) of said coupling link (48).

7. The structure according to claim 1, further including a floating connecting joint (11) between said operating rod (5) and said stopper means (6), said floating connecting joint comprising means for defining a first part-spherical surface (80) with a first radius (R1) located at a lower end of the operating rod;

means for defining a second part-spherical surface (84) having a second radius (R2) upwardly of said first part-spherical surface and facing in the opposite direction thereof;

a first counter surface (82) formed in the stopper means (6) and cooperatively positioned for cooperation with said first part-spherical surface (80);

a second counter surface (86) on said stopper means (6) and cooperatively positioned for cooperation with said second part-spherical surface;

said first part-spherical surface (80) and said counter surface (82) being positioned with respect to each other with play or a gap (S) therebetween;

wherein the centers of the radii (R1, R2) are located on the longitudinal axis (M) of the operating rod; and wherein at least said first part-spherical surface (80) and said first counter surface (82) are formed of different materials.

8. The structure according to claim 7, wherein the first radius (R1) is larger than the second radius (R2).

9. The structure according to claim 7, wherein said second part-spherical surface (84) and said second counter surface (86) are formed of different materials.

10. The structure according to claim 7, wherein the first counter surface (82) is part-spherical and the second counter surface (86) is conical.

11. The structure according to claim 1, further including a first sealing part (3', 18) formed at an upper end portion of the outlet pipe;

a second sealing part (16) formed on said stopper means, dimensioned and shaped to fit against said first sealing part, said first and second sealing parts forming a first seal (20) for the melt; and a second seal (21), said second seal comprising an annular cylindrical part (19) having a closed outer surface and extending from said stopper means (6) into the outlet pipe (3, 3') and defining, beneath said stopper means and said first seal, a cylindrical second plug seal (21);

said first seal opening first upon raising of said stopper means (6) by said operating rod (5) and said second seal opening subsequently to opening of said first seal.

12. The structure according to claim 1, wherein said stopper means (6) comprises an essentially cylindrical plug element (13) depending from said stopper means, said plug element (13) being formed with an essentially longitudinal discharge opening (15) having a lower end discharging into said outlet pipe (3, 3", 7);

at least one essentially radially directed aperture (14) communicating with said discharge opening (15);

said plug element (13) further comprising a cylindrical annular part (19) having a closed outer surface and located above said aperture (14), said cylindrical annular part having an axial portion of predetermined dimension (V) which fits within said outlet pipe (3, 7) to form therewith a seal (21).

13. The structure according to claim 12, further including a coupling link means (11, 1311) permitting limited relative deflection of the stopper means (6) and said plug element (13) with respect to said operating rod (5) in a vertical and a horizontal plane located between the stopper means (6) and positioned at least at the lower end of the rod (5) to permit limited movement of the plug element (13) with respect to the link means and self-alignment of said seal (21).

14. An outlet valve structure to control flow of a metallic melt, adapted for installation in the bottom (2) of a vessel (1) containing the melt, said valve structure comprising an essentially vertically positioned outlet pipe (3, 3', 3") having a vertical bore (7) therethrough;

stopper means (6) dimensioned and shaped to fit against said outlet pipe;

an operating rod (5) extending in vertical direction within and outside of said vessel (1);

a hollow sleeve or stem (10) extending from said stopper means (6) and surrounding said operating rod with radial play or clearance; and a stopper support arm (23, 123) extending laterally of the operating rod (5) and above the level (H) of the melt in the vessel, and further comprising, a floating connecting joint (11) between said operating rod (5) and said stopper means (6), said floating connecting joint comprising means for defining a first part-spherical surface (80) with a first radius (R1) located at a lower end of the operating rod;

means for defining a second part-spherical surface (84) having a second radius (R2) upwardly of said first part-spherical surface and facing in the opposite direction thereof;

a first counter surface (82) formed in the stopper means (6) and cooperatively positioned for cooperation with said first part-spherical surface (80);

a second counter surface (86) on said stopper means (6) and cooperatively positioned for cooperation with said second part-spherical surface;

said first part-spherical surface (80) and said counter surface (82) being positioned with respect to each other with play or a gap (S) therebetween;

wherein the centers of the radii (R1, R2) are located on the longitudinal axis (M) of the operating rod; and wherein at least said first part-spherical surface (80) and said first counter surface (82) are formed of different materials.

15. The structure according to claim 14, wherein the first radius (R1) is larger than the second radius (R2).

16. The structure according to claim 14, wherein said second part-spherical surface (84) and said second counter surface (86) are formed of different materials.

17. The structure according to claim 14, wherein the first counter surface (82) is part-spherical and the second counter surface (86) is conical.

18. The structure according to claim 14, further including a first sealing part (3', 18) formed at an upper end portion of the outlet pipe;

a second sealing part (16) formed on said stopper means, dimensioned and shaped to fit against said first sealing part, said first and second sealing parts forming a first seal (20) for the melt; and a second seal (21), said second seal comprising an annular cylindrical part (19) having a closed outer surface and extending from said stopper means (6) into the outlet pipe (3, 3') and defining, beneath said stopper means and said first seal, a cylindrical second plug seal (21);

said first seal opening first upon raising of said stopper means (6) by said operating rod (5) and said second seal opening subsequently to opening of said first seal.

19. The structure according to claim 14, wherein said stopper means (6) comprises an essentially cylindrical plug element (13) depending from said stopper means, said plug element (13) being formed with an essentially longitudinal discharge opening (15) having a lower end discharging into said outlet pipe (3, 3", 7);

at least one essentially radially directed aperture (14) communicating with said discharge opening (15);

said plug element (13) further comprising a cylindrical annular part (19) having a closed outer surface and located above said aperture (14), said cylindrical annular part having an axial portion of predetermined dimension (V) which fits within said outlet pipe (3, 7) to form therewith a seal (21).

20. The structure according to claim 19, further including a coupling link means (11, 1311) permitting limited relative deflection of the stopper means (6) and said plug element (13) with respect to said operating rod (5) in a vertical and a horizontal plane located between the stopper means (6) and positioned at least at the lower end of the rod (5) to permit limited movement of the plug element (13) with respect to the link means and self-alignment of said seal (21).

* * * * *